US007318561B1

(12) United States Patent
Giampietro

(10) Patent No.: US 7,318,561 B1
(45) Date of Patent: Jan. 15, 2008

(54) LIGHT SAVER

(76) Inventor: Clifford Giampietro, 27 Valley Rd., Succasunna, NJ (US) 07876

( * ) Notice: Subject to any disclaimer, the term of this patent is extended or adjusted under 35 U.S.C. 154(b) by 348 days.

(21) Appl. No.: 11/101,253

(22) Filed: Apr. 7, 2005

Related U.S. Application Data

(60) Provisional application No. 60/560,783, filed on Apr. 7, 2004.

(51) Int. Cl.
*B65H 75/28* (2006.01)

(52) U.S. Cl. ..... 242/402; 242/405.1; 242/407; 242/613.1

(58) Field of Classification Search ..... 242/402, 242/405, 405.1, 407, 118.4, 613, 407.1, 588, 242/602, 602.1, 602.3, 613.1–613.2, 118, 242/125, 125.1; 191/12.2 R
See application file for complete search history.

(56) References Cited

U.S. PATENT DOCUMENTS 5,064,067 A * 11/1991 McAllister et al. ..... 206/420
5,676,250 A * 10/1997 Walters ..... 206/419
5,695,148 A 12/1997 Christensen
5,868,334 A * 2/1999 Cedillo ..... 242/405.3
5,924,570 A * 7/1999 Sickles ..... 206/419
5,957,401 A 9/1999 O'Donnell
6,398,148 B1 * 6/2002 Snow ..... 242/395.1
6,431,489 B1 * 8/2002 Rose ..... 242/405.2
6,497,381 B2 12/2002 Rose
6,557,792 B1 * 5/2003 Snow ..... 242/395.1

* cited by examiner

*Primary Examiner*—Peter M. Cuomo
*Assistant Examiner*—Sang Kim

(57) ABSTRACT

A storage apparatus for decorative and holiday lights. The storage apparatus has a central rod with two disc-shaped ends, with the rod having a plurality of nodules. Each of the ends has a groove for insertion of an end of a string of decorative and holiday lights. The entire string of decorative and holiday lights can be wound around the rod, taking care to separate successive wrappings around the central rod by using the spacing of the nodules.

7 Claims, 1 Drawing Sheet

LIGHT SAVER

I. CROSS-REFERENCE TO RELATED APPLICATIONS

Figure 1:
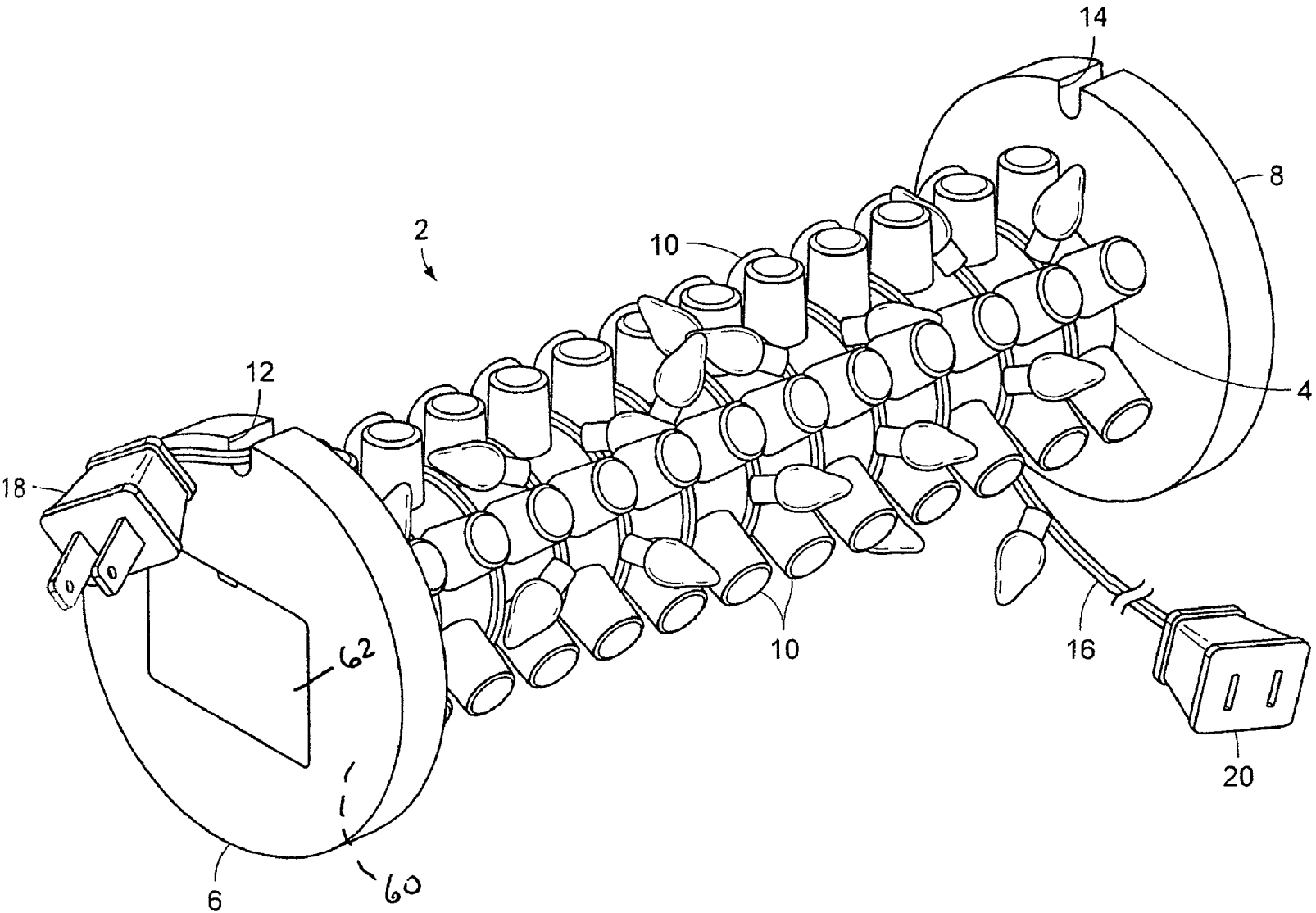

This application claims the benefit of U.S. Provisional Application No. 60/560,783, filed Apr. 7, 2004.

II. BACKGROUND OF THE INVENTION

The present invention concerns that of a new and improved type of storage apparatus for decorative and holiday lights.

III. DESCRIPTION OF THE PRIOR ART

U.S. Pat. No. 5,957,401, issued to O'Donnell, discloses a device for storing a string of holiday lights, comprised of a spool having slits on each end to engage the cord and includes a storage receptacle for extra bulbs.

U.S. Pat. No. 5,695,148, issued to Christensen and U.S. Pat. No. 6,497,381, issued to Rose, disclose additional spool assemblies for winding and storing a string of Christmas lights.

IV. SUMMARY OF THE INVENTION

The present invention concerns that of a new and improved type of storage apparatus for decorative and holiday lights. The storage apparatus has a central rod with two disc-shaped ends, with the rod having a plurality of nodules. Each of the ends has a groove for insertion of an end of a string of decorative and holiday lights. The entire string of decorative and holiday lights can be wound around the rod, taking care to separate successive wrappings around the central rod by using the spacing of the nodules.

There has thus been outlined, rather broadly, the more important features of a storage apparatus for decorative and holiday lights that the detailed description thereof that follows may be better understood and in order that the present contribution to the art may be better appreciated. There are, of course, additional features of the storage apparatus for decorative and holiday lights that will be described hereinafter and which will form the subject matter of the claims appended hereto.

In this respect, before explaining at least one embodiment of the storage apparatus for decorative and holiday lights in detail, it is to be understood that the storage apparatus for decorative and holiday lights is not limited in its application to the details of construction and to the arrangements of the components set forth in the following description or illustrated in the drawings. The storage apparatus for decorative and holiday lights is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present storage apparatus for decorative and holiday lights. It is important, therefore, that the claims be regarded as including such equivalent constructions insofar as they do not depart from the spirit and scope of the present invention.

It is therefore an object of the present invention to provide a storage apparatus for decorative and holiday lights which has all of the advantages of the prior art and none of the disadvantages.

It is another object of the present invention to provide a storage apparatus for decorative and holiday lights which may be easily and efficiently manufactured and marketed.

It is another object of the present invention to provide a storage apparatus for decorative and holiday lights which is of durable and reliable construction.

It is yet another object of the present invention to provide a storage apparatus for decorative and holiday lights which is economically affordable and available for relevant market segment of the purchasing public.

Other objects, features and advantages of the present invention will become more readily apparent from the following detailed description of the preferred embodiment when considered with the attached drawings and appended claims.

V. BRIEF DESCRIPTION OF THE DRAWINGS

FIG. 1 shows a perspective view of the storage apparatus for decorative and holiday lights.

VI. DESCRIPTION OF THE PREFERRED EMBODIMENT

FIG. 1 shows a perspective view of the storage apparatus 2 for decorative and holiday lights. Storage apparatus 2 comprises a central rod 4 that has two ends, a first end and a second end. Attached to the first end of the central rod 4 is disc 6, while attached to the second end of the central rod 4 is disc 8.

Each of the discs 6 and 8 have two surfaces, an outer surface and an inner surface. Further, each of the discs 6 and 8 has a continuous side surface. Disc 6 has a groove 12, while disc 8 has a groove 14. Disc 6 also has a storage compartment 60 for extra fuses and lights, with the storage compartment being covered by cover 62.

Located on the central rod 4 are a plurality of nodules 10, which have the approximate shape of upside-down thimbles. The nodules 10 are spaced out in linear rows.

Also in FIG. 1, a string of decorative and holiday lights 16 can be seen. The decorative and holiday lights 16 generally has two ends, a first end and a second end. The first end of the decorative and holiday lights always has a male plug 18, while the second end of a string of decorative and holiday lights can either have a female plug 20 or just end with a light. Usually, a female plug 20 is present, as seen in FIG. 1.

The storage apparatus 2 can be used to easily store the string of decorative and holiday lights 16 so they do not tangle up, as decorative and holiday lights typically do. Generally, the male plug 18 is inserted through the groove 12, with the male plug 18 hanging beyond the outer surface of the disc 6. Then, the string of decorative and holiday lights 16 is wound around the perimeter of the central rod 4, over and over, taking care to slowly move the location of the string of decorative and holiday lights 16 from one end of the central rod 4 to the other end of the central rod 4. This action prevents the row of decorative and holiday lights 16 from becoming too deep or too high in any one location on the central rod. As long as the string of decorative and holiday lights 16 is slowly moved from one end to the other end of the central rod 4, the presence of the plurality of nodules 10 ensures that the string of decorative and holiday lights 16 will not become tangled.

When the string of decorative and holiday lights 16 is finally done being wound around the central rod, then the remaining end of the string of decorative and holiday lights 16 can be inserted into the groove 14 on disc 8 such that the female plug 20 is located a little beyond the outside surface of the disc 8. Then, the storage apparatus 2 can be stored away, knowing that the string of decorative and holiday lights 16 will not tangle or get ruined by traditional storage methods.

Storage apparatus 2 is preferably made in at least three different sizes and is manufactured from rubber or plastic.

I claim:

1. A storage apparatus for storing a string of decorative and holiday lights, each string having a plurality of bulbs the storage apparatus comprising:

central rod having a first end and a second end, a first disc attached to the first end of the central rod, the first disc having an outer surface, an inner surface, a continuous side surface, and a groove, a second disc attached to the second end of the central rod, the second disc having an outer surface, an inner surface, a continuous side surface, and a groove, a plurality of nodules located on the central rod, the nodules protruding in a generally outward direction from the central rod and extending from the first disc to the second disc with at least one nodule positioned adjacent the first disc and at least one nodule positioned adjacent the second disc, a string of holiday lights, the string of holiday lights having a first end and a second end, and a male plug attached to the first end of the string of holiday lights, wherein the male plug is inserted through the groove on the first disc, and further wherein the string of holiday lights is repeatedly wound around the central rod, and further wherein the second end of the string of holiday and decorative lights is inserted through the groove on the second disc, further wherein the storage apparatus can be placed in storage.

2. A storage apparatus according to claim 1 wherein each of the nodules on the plurality of nodules located on the central rod have the shape of an upside-down thimble.

3. A storage apparatus according to claim 1 wherein the second end of the string of holiday lights ends in a light.

4. A storage apparatus according to claim 1 wherein the storage apparatus further comprises a female plug, the female plug being located at the second end of the string of holiday lights.

5. A storage apparatus according to claim 1 wherein the nodules are aligned in rows, each row containing a plurality of nodules, each row containing the same number of nodules as each adjacent row.

6. A storage apparatus according to claim 1 wherein each nodule is spaced from each adjacent nodule by a distance less than a width of one of the bulbs.

7. A storage apparatus according to claim 1 wherein each nodule has a side surface, the side surface of each nodule being substantially perpendicular to the central rod.

* * * * *